United States Patent [19]

Tsuchiya

[11] 4,403,140

[45] Sep. 6, 1983

[54] ELECTRON-BEAM SHUTTER AND SHUTTER TUBE

[75] Inventor: Yutaka Tsuchiya, Hamamatsu, Japan

[73] Assignee: Hamamatsu TV Co., Ltd., Hamamatsu, Japan

[21] Appl. No.: 270,393

[22] Filed: Jun. 4, 1981

[30] Foreign Application Priority Data

Aug. 22, 1980 [JP] Japan ..... 55-116241

[51] Int. Cl.[3] ..... H01J 31/50

[52] U.S. Cl. ..... 250/213 VT; 313/293; 313/529

[58] Field of Search ..... 250/207, 213 R, 213 VT; 313/94, 99, 422, 381

[56] References Cited

U.S. PATENT DOCUMENTS 4,012,657 3/1977 Loty ..... 313/99

4,350,919 9/1982 Johnson et al. ..... 250/213 VT

*Primary Examiner*—David C. Nelms

*Attorney, Agent, or Firm*—Wenderoth, Lind & Ponack

[57] ABSTRACT

An electron-beam shutter for use in an optoelectronic device that forms an image of a luminous event changing at high speed on a screen comprises a shutter plate and a ramp voltage source. The shutter plate has a multitude of through holes extending perpendicular to its surface and a pair of electrodes disposed at its opposite edges and spaced away from each other in a direction perpendicular to the axis of the through holes. The ramp voltage source is connected to the aforesaid electrodes, and the polarity of the ramp voltage changes in a reversing manner. The ramp voltage develops an electric field that crosses the axis of the through holes in the shutter plate and controls the passage of electron beams through the through holes.

2 Claims, 8 Drawing Figures

ELECTRON-BEAM SHUTTER AND SHUTTER TUBE

BACKGROUND OF THE INVENTION

This invention relates to an electron-beam shutter and a shutter tube incorporating an electron-beam shutter used in optoelectronic devices that record fast-transient luminous images.

To pick up any object that changes or vibrates at high speed, it is necessary to make the exposure time extremely short. In photographing, exposure is given by mechanical means. Meanwhile, optoelectronic image tubes convert images by use of the effect of photoelectric emission. In such an image tube, a fine-mesh electrode is provided close to, and parallel to, the photocathode. Usually, the electrode is held at a potential lower than that of the photocathode to prevent the passage of an electron-beam image. A potential higher than that of the photocathode is given to the electrode at a desired exposure time for a desired time length. Then, an electron-beam image, which corresponds to a luminous image projected on the photocathode, is passed to the fluorescent screen of the image tube at the desired time to reproduce the image of the original luminous event thereon, which is then recorded either on a photographic film or by use of a television camera.

In another type of image tube, there is provided, at a suitable point in the path of an electron-beam image between the photocathode and the fluorescent screen, a deflecting electrode which consists of two deflection plates disposed parallel to and on both sides of the path. Usually voltage is applied between the two deflection plates so that the electron-beam image does not reach the fluorescent screen. At a desired exposure time, the voltage applied between the two deflection plates is varied, whereby the electron-beam image, which corresponds to luminous image projected on the photocathode, reaches the fluorescent screen to reproduce the original image thereon when the voltage between the two deflection plates becomes small enough.

The image tubes having the above-described functions are called shutter tubes and used for the observation and analysis of such fast-transient events as spark discharge, explosion, combustion in the internal combustion engine, and impulse wave.

The same functions as above can be attained by providing a fine-mesh or deflecting electrode in the image section of such television cameras as an image orthicon and a silicon intensifier target vidicon, too.

The optoelectronic devices to record luminous images changing at high speed must be controlled to that only such electron beams are passed to the fluorescent screen or storage target as are emitted from the photocathode in such an extra-short time as several nanoseconds or even shorter. Namely, the electron-beam shutter must operate in such an extra-short time. As will be discussed at length later, however, the conventional electron-beam shutters have been unable to provide high enough shutter speeds to catch fast-transient luminous images.

An electron-beam shutter tube having a focusing electrode has the problem of applying high accelerating voltage on photoelectrons because of the great distance between the photocathode and fluorescent screen. The shutter tube of this type is large in size for the same reason. To operate the shutter properly, therefore, high shutter voltage must be applied on the fine-mesh or deflecting electrode.

In an electron-beam shutter tube consisting of a proximity type image tube without a focusing electrode but having a fine-mesh electrode too, high shutter voltage must be applied.

SUMMARY OF THE INVENTION

An object of this invention is to provide an electron-beam shutter operating in an extremely short time designed for use with optoelectronic devices to take hold of changing luminous images.

Another object of this invention is to provide an electron-beam shutter that permits reducing the size of optoelectronic devices.

Still another object of this invention is to provide an electron-beam shutter that can remarkably lower the voltages applied to accelerate photoelectrons and operate the shutter.

Yet another object of this invention is to provide a small, simply structured shutter tube incorporating such electron-beam shutters as mentioned above.

An electron-beam shutter according to this invention, for use with optoelectronic devices to reproduce luminous images changing at high speed, comprises a shutter plate having a pair of oppositely disposed electrodes and a ramp voltage generating source connected to the electrodes. The shutter plate has many parallel through holes perforated at right angles with the surface thereof. Usually, electron beams are prevented from passing through the through holes by the electric field created by a voltage that exists before a ramp voltage is generated by the ramp voltage generating source. When the ramp voltage comes down close to zero volts, the electric field too approaches zero to permit the passage of the electron beams through the through holes. When the voltage becomes reversed in polarity and increases, the passage of the electron beams is prevented again. Thus, in an optoelectronic device using this electron-beam shutter, an electron beam corresponding to a luminous image entering the photocathode passes through the through holes in the shutter plate in an extremely short period of time during which the output voltage of the ramp voltage generating source approaches zero volts. The electron beam thus allowed to pass hits the fluorescent screen to reproduce an image of the original luminous event thereon.

In this electron-beam shutter, electron beams are directed to pass through the long, narrow through holes provided in the shutter plate. The electron beams are deflected by an electric field created by the voltage applied to the shutter plate. When the amount of deflection is large, the electron beams strike against, and then are absorbed by, the inside wall of the through holes. When the amount of deflection is small, the electron beams are allowed to pass through the through holes. Accordingly, the passage of the electron beams through the through holes in the shutter plate can be controlled by varying the deflecting voltage to a small extent. As a consequence, high shutter speed is obtained.

Being flat, the shutter plate can be placed close and parallel to a flat photocathode. Then too, a flat fluorescent screen can be placed close to that side of the shutter plate which is opposite to the other side facing the photocathode. Even when the voltage applied between the photocathode and shutter plate is relatively low, therefore, photoelectrons hit the shutter plate without diffusing in a direction parallel to the photocathode.

Having passed through the shutter plate, the photoelectrons move forward substantially parallel to the through holes and impinge on the fluorescent screen. Being so designed, the shutter tubes having an electronic-beam shutter according to this invention need no focusing electrode. Accordingly, simple and small shutter tubes result.

DETAILED DESCRIPTION OF THE PREFERRED EMBODIMENTS

To facilitate the understanding of this invention, the structure, operation and shortcomings of conventional shutter tubes are described first by reference to a few shutter tubes of the image tube type. By the way, a shutter tube of the image orthicon tube type is identical to structure and operation with the image tube type, except that the image orthicon tube type has a storage target in place of the fluorescent screen in the image tube type and a read-out function based on electron-beam scanning that is inherent thereto.

Figure 1:
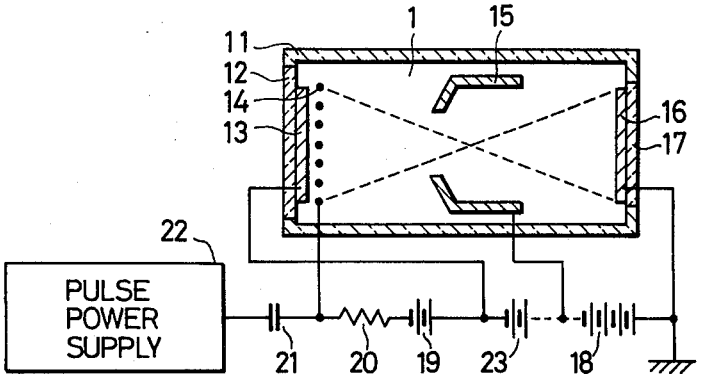
FIG. 1 PRIOR ART
FIGS. 1, 2 and 3 are cross sections showing the structures of conventional shutter tubes.

FIG. 1 is a cross sectional view showing the longitudinal structure and power supply circuit of a conventional shutter tube of the image tube type. In FIG. 1, reference numeral 1 designates a shutter tube, 11 a closed-end cylindrical airtight vacuum container making up the shutter tube 1, 12 a light incidence window provided in a first end of the airtight vacuum container 11, 13 a photocathode provided on the inside of the light incidence window 12, 14 a fine-mesh electrode provided close and parallel to the photocathode 13, 15 a focusing electrode that is coaxial with and rotationally symmetrical to the airtight vacuum container 11, and 16 a fluorescent screen that is provided on the inside of a light emitting window 17 in a second end of the airtight vacuum container 11. The fluorescent screen is connected to a positive electrode of a direct current power supply 18, the focusing electrode 15 is connected to a point where the negative electrode of the d.c. power supply 18 and the positive electrode of another d.c. power supply 23 are connected, and the photocathode 13 is connected to a point where the negative electrode of the d.c. power supply 23 and the positive electrode of still another d.c. power supply 19 are connected. The fine-mesh electrode 14 is connected through a resistor 20 to the negative electrode of the d.c. power supply 19. The fine-mesh electrode 14 is also connected through a capacitor 21 to a rectangular pulse power supply 22.

The photoelectrons emitted from the photocathode 13 travel in a direction that forms an angle $\theta$ with the direction perpendicular to the photocathode with a probability approximately proportional to cos $\theta$. The kinetic energy of the photoelectrons are distributed between 0 electron volt and approximately 2 electron volts. The focusing electrode 15 is provided so that the photoelectrons emitted from one point on the photocathode 13 be focused on one point on the fluorescent screen 16 in spite of such initial velocity distribution of the photoelectrons as mentioned above. Namely, the focusing electrode 15 forms an electron lens between the photocathode 13 and fluorescent screen 16. Yet, because of the presence of the focusing electrode 15 in between, the distance between the photocathode 13 and fluorescent screen 16 becomes so great that adequate focusing effect cannot usually be attained unless high voltage is applied therebetween. For this reason, the output voltages of the power supplies 23 and 18 together amount to as much as 10-odd kilovolts.

The power supply 19 must output approximately 30 volts of power. When this voltage is applied between the photocathode 13 and the fine-mesh electrode 14 (against the voltage between the photocathode 13 and fluorescent screen 16), the electrons emitted from the photocathode 13 cannot pass through the fine-mesh electrode 14 and, therefore, does not produce an image on the fluorescent screen 16. When, under this condition, a positive rectangular pulse is inputted from the pulse power supply 22 into the fine-mesh electrode 14, the electrode 14 becomes positive during that time to pass the electrons therethrough to form an image on the fluorescent screen 16. To focus electron beams, the rectangular pulse needs to have a voltage of 300 volts to 2 kilovolts. During the pulse rise and fall times, however, this focusing condition is not satisfied, so that image deterioration results. This is also the case when the pulse top (amplitude) oscillates. To pick up an object that changes at ultra-high speed, the amplitude of the rectangular pulse must be made small according to the speed of the change. Because of the problems with the pulse generating technique, the parasitic capacitance of the fine-mesh electrode 14, the impedance matching between the fine-mesh electrode 14 and transmission cable, etc., it is very difficult to generate, and apply on the fine-mesh electrode 14, a rectangular pulse that is shorter than approximately 5 nanoseconds, rises and falls steeply, and has a flat top.

Figure 2:
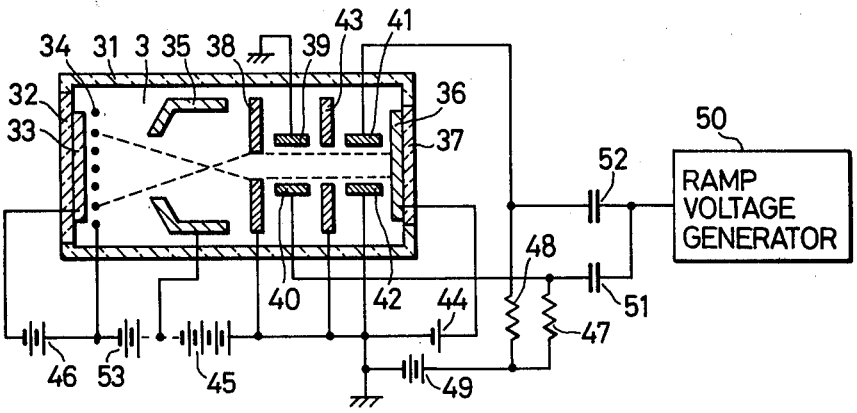
FIG. 2 PRIOR ART

FIG. 2 shows the longitudinal cross-sectional structure and power supply circuit of another conventional shutter tube of the image tube type.

In FIG. 2, reference numeral 3 denotes a shutter tube, 31 a closed-end cylindrical airtight vacuum container making up the shutter tube 3, 32 a light incidence window provided in a first end of the airtight vacuum container 31, 33 a photocathode provided on the inside of the light incidence window 32, 34 a fine-mesh electrode provided close and parallel to the photocathode 33, 35 a focusing electrode that is coaxial with and rotationally symmetrical to the airtight vacuum container 31, and 36 a fluorescent screen that is provided on the inside of a light emitting window 37 in a second end of the airtight vacuum container 31. Reference numeral 38 designates an anode plate having an aperture at the center. Reference numerals 39 and 40 designate two deflecting plates disposed parallel to and on both sides of the path of electron beams, the two together constituting a first deflecting electrode. Items 41 and 42 too are deflecting plates disposed parallel to and on both sides of the path of electron beams, the two together constituting a second deflecting electrode. Reference numeral 43 denotes an aperture plate provided between the first and second diflecting electrodes.

Direct current power supplies 46, 53 and 45 apply a voltage of approximately 16 kilovolts between the photocathode 33 and anode plate 38. The focusing electrode 35 is connected to a point where the d.c. power supplies 53 and 45 are connected. A voltage of approximately 3 kilovolts is applied between the focusing electrode 35 and photocathode 33. A d.c. power supply 44 applies a voltage of not higher than 1 kilovolt is applied between the anode plate 38 and fluorescent screen 36. The voltage at the fluorescent screen 36 may be zero; that is, the d.c. power supply 44 may be eliminated. The d.c. power supply 46 applies a voltage of 1 to 2 kilovolts between the photocathode 33 and fine-mesh electrode 34. The aperture plate 43 is kept at the same potential as the anode plate 38. Both the deflecting plate 40 of the first deflecting electrode and the deflecting plate 41 of the second deflecting electrode are connected to the positive electrode of the positive electrode of a d.c. power supply 49 through a resistor 47 and a resistor 48, respectively. The negative electrode of the d.c. power supply 49 is connected to the aperture plate 43, the deflecting plate 39 of the first deflecting electrode, the deflecting plate 42 of the second deflecting electrode, and the anode plate 38, and is grounded. The output voltage of the d.c. power supply 49 is approximately 2 kilovolts. The deflecting plate 40 and the deflecting plate 41 are connected to the output terminal of a high-speed ramp voltage generator 50 through a capacitor 51 and a capacitor 52, respectively.

Before the high-speed ramp voltage generator 50 begins to change voltage, electrons are drawn toward the deflecting plate 40 and hit the aperture plate 43, so that no image is produced on the fluorescent screen 36. When the ramp voltage generator 50 starts to change the output voltage in the negative direction, electron beams are swept. Upon this sweeping, the deflecting plate 39 and 40, and the deflecting plate 41 and 42, attain substantially the same potential, and the electron beams reach the fluorescent screen 36 to form an image thereon passing through the openings in the first deflecting electrode, aperture plate 43, and the second deflecting electrode. The ramp voltage applied to the first and second deflecting electrodes must be several kilovolts in order to deflect the electrons accelerated to 10-odd kilovolts through a great angle. When the sweep speed is so great that the voltage of the second deflecting electrode, reversing through 0 volt, is likely to become higher than the desired level when the electrons from through the first deflecting electrode reaches the second deflecting electrode, application of the ramp voltage on the second deflecting electrode must be delayed by a suitable length of time after the ramp voltage application on the first deflecting electrode.

Such a ramp voltage can be generated by shorting a capacitor that has been charged up to a high voltage. Since a single transistor cannot withstand such high voltage, several or even more than ten transistors arranged in series must be used in a switching circuit used for this purpose. A switching circuit comprising several series-connected transistors has a longer switching time than a single-transistor switching circuit. The maximum voltage change speed obtainable from the ramp voltage generator is about 5 volts per picosecond. Therefore, it is impossible to obtain a shorter exposure time than 400 picoseconds that is necessary for assuring the deflecting voltage of 2 kilovolts to perform proper exposure. Furthermore, it is difficult to perform exact switching in the desired timing since the time between the input of trigger signal and the completion of the transistor shorting (i.e. response time) differs with individual transistors and also with the magnitude of trigger signals. Then too, the sweep voltage applied on the first and second deflecting electrodes must sometimes be differentiated in amplitude and phase. In addition, the presence of the focusing electrode 35 prevents shortening the space between the photocathode 33 and the anode plate 38 in the shutter tube 3. This calls for the application of high voltage between the photocathode 33 and anode plate 38. The electron beams, which are accelerated between the photocathode 33 and anode plate 38 and passed to the deflecting electrode, cannot be deflected by low voltage. This is also impossible for the impossibility to obtain a shorter exposure time than approximately 400 picoseconds.

Figure 3:
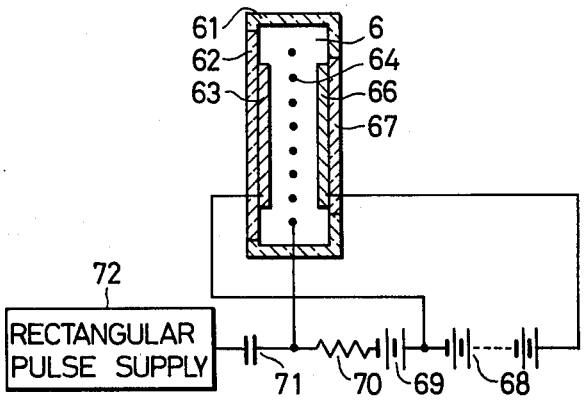
FIG. 3 PRIOR ART

FIG. 3 shows the longitudinal cross-sectional structure and power supply circuit of still another conventional shutter tube of the image tube type. In FIG. 3, reference numeral 6 designates a shutter tube, 61 an airtight vacuum container, 62 a light incidence window, 63 a photocathode, 64 a fine-mesh electrode 64, 66 a fluorescent screen, and 67 a window through which an image formed on the fluorescent screen 66 is sent out. The fluorescent screen 66 is connected to a positive electrode of a direct current power supply 68, and the photocathode 63 is connected to a point where the negative electrode of the d.c. power supply 68 and the positive electrode of another d.c. power supply 69 are connected. The fine-mesh electrode 64 is connected through a resistor 70 to the negative electrode of the d.c. power supply 69. The fine-mesh electrode 64 is also connected through a capacitor 71 to a rectangular pulse power supply 72. Compared with the shutter tube of FIG. 1, the shutter tube in FIG. 3 dispenses with the focusing electrode 15, but has the fine-mesh electrode 64 disposed between the photocathode 63 and fluorescent screen 66 instead. This permits reducing the distance between the photocathode 63 and fluorescent screen 66 and, therefore, the length of the shutter tube 6 as well as making the voltage applied between the photocathode 63 and fluorescent screen 66 relatively low. Yet, as with the shutter tube shown in FIG. 1, this shutter tube also requires high-speed rectangular pulse that is difficult to produce. Besides, this shutter tube cannot provide as high a resolution as is obtainable from the shutter tube of FIG. 1.

Figure 4:
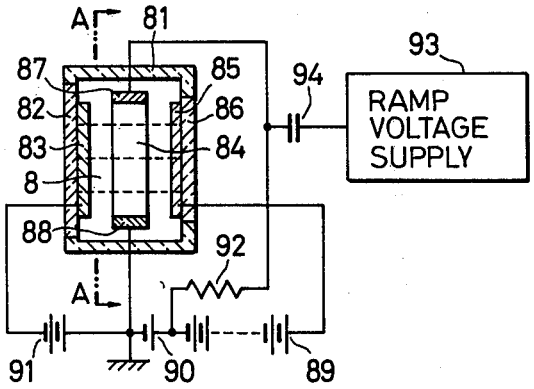
FIG. 4 is a cross section showing the structure of a shutter tube embodying the principle of this invention.

Now this invention will be described in detail by reference to illustrated preferred embodiments thereof. FIG. 4 shows the longitudinal cross-sectional structure and power supply circuit of a shutter tube according to this invention. In FIG. 4, reference numeral 8 designates a shutter tube, in which a photocathode 83 is provided on the inside of a light incidence window 82 provided in a first end of a closed-end cylindrical airtight vacuum container 81. A fluorescent screen 85 opposite to the photocathode 83 is provided on the inside of a light emitting window 86 provided in a second end of the airtight vacuum container 81. Direct current power supplies 89, 90 and 91 are connected in series. The positive electrode of the power supply 89 is connected to the fluorescent screen 85, and the negative electrode of the power supply 91 is connected to the photocathode. Accordingly, the fluorescent screen 85 is kept at a higher potential than the photocathode.

Figure 5:
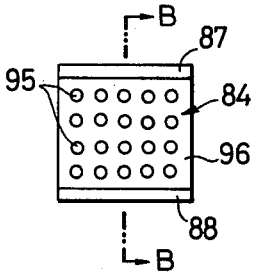
FIG. 5 is a front view of a shutter plate used for the electron-beam shutter according to this invention.
Figure 6:
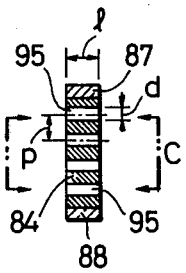
FIG. 6 is a cross-sectional view taken along the line B—B of FIG. 5.

Reference numeral 84 denotes a shutter plate that is disposed between, and close and parallel to, the photocathode 83 and fluorescent screen 85. The structure and operation of the shutter plate 84 will be described by reference to FIGS. 5, 6 and 7. FIG. 5 is a front view of the shutter plate 84, viewed from the direction in which electrons enter in FIG. 4 (i.e. a cross-section taken along the line A—A of FIG. 4). FIG. 6 is a cross-sectional view taken along the line B—B of FIG. 5. FIG. 5 enlarges part C in FIG. 6.

Figure 7:
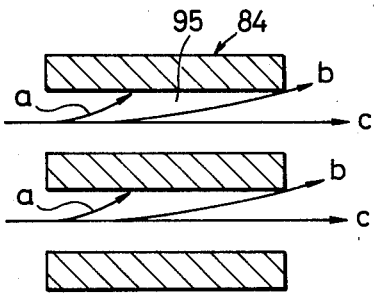
FIG. 7 is a view enlarging part C in FIG. 6.

The shutter plate 84 consists of a substrate 96 having two electrodes 87 and 88 at opposite ends thereof, with through holes 95 provided regularly, and with as uniform density as possible, throughout the entire area between the two electrodes 87 and 88. The through holes 95 are made to as much the same diameter as possible. Each through hole 95 extends straight. The size of the through hole 95 is by far smaller than that of the shutter plate 84; for example, approximately one million through holes are provided in a 10 mm square substrate. In FIGS. 5, 6 and 7, through holes are drawn much larger than their actual size for the convenience of illustration.

The following is a brief description of the material and manufacturing method of the shutter plate. The electrical properties required of the shutter plate are:

(1) to create a substantially uniform potential gradient between the electrodes 87 and 88 when voltage is applied therebetween, and (2) to absorb the electrons striking against the internal walls of the through holes 95. To manufacture such a shutter plate, a concentric double glass rod is prepared first by filling a glass readily soluble in acid in a tube of lead glass. A large number (e.g. 1,000) of such concentric double glass rods are put together in a circular frame. The bundle of the concentric double glass rods is heated to the melting temperature of the lead glass, and acid-soluble glass is filled in the space between the rods. While heating, the whole aggregate is stretched out to produce a glass fiber which consists of a core of the acid-soluble glass covered with the lead glass. (Hereinafter this glass fiber will be called the single fiber.) The diameter of the single fiber is approximately 1 mm. Then, several thousands of single fibers are collected parallel to each other, put in a frame, heated, and stretched out in the longitudinal direction of the fiber. Consequently, the external layers of the single fibers melt to cling together to produce a thinner fiber (hereinafter called the multi-fiber). The diameter of this multi-fiber is also approximately 1 mm. Several hundreds of multifibers, arranged parallel to each other, are heated in a frame to produce a glass rod having approximately one million cores. By slicing the glass rod along two planes perpendicular to the cores, a plate having many cores perpendicular to the surfaces thereof is obtained. This plate is approximately 1 mm in thickness. When this plate is dipped in an aqueous solution of acid, the core glass melts away to leave through holes. On heating the lead glass plate with the through holes in hydrogen, the lead separates out on the surface. The precipitated lead forms a conductive layer. After removing the lead conductive layer, except on the internal wall of the through holes, molybdenum is evaporated on the surfaces of the plate. The molybdenum forms a high-resistance layer on the plate surfaces. The electrodes are formed by evaporating chromium or aluminum. According to this method, a shutter plate having, for example, through holes 15 microns in diameter, spaced at intervals of 19 microns, can be manufactured.

The shutter plate can be manufactured by another method too, in which a film of platinum is formed on the inside of the through holes provided in a plate of insulating ceramic. The platinum layer is formed by dipping the ceramic plate in liquid gold, which is a solution consisting of platinum chloride, sulfur and turpentine oil, and baking. As in the above-described method, molybdenum is evaporated on the surfaces to form the high-resistance layer and chromium or aluminum is evaporated to form the electrodes.

The shutter plate 64 has a little larger area than the photocathode 83 and fluorescent screen 85. Preferably, the thickness l of the shutter plate is between approximately 1 and 10 mm. The preferable diameter d of the through hole is between approximately 10 and 500 microns. The pitch p is a little larger than the diameter of the through hole.

Figure 8:
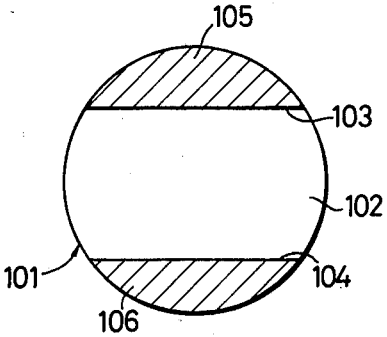
FIG. 8 is a front view showing another example of the shutter plate used for the electron-beam shutter of this invention.

The shape of the shutter plate is not limited to the example shown in FIG. 5. For example, as in a shutter plate 101 shown in FIG. 8, a circular substrate 102, having electrodes 105 and 106 provided on the outside of the parallel two chords 103 and 104 therein, may be used. The shutter operation of this invention can be achieved even if the borderlines between the electrode section and the through-hole section are neither straight nor parallel to each other. Yet, to produce the same electric field in all through holes, it is preferable that the borderlines be straight and parallel to each other.

The electrode 88 of the shutter plate 84 is connected to the positive electrode of the d.c. power supply 91 which outputs a voltage of 1 kilovolt. The other electrode 87 is connected through a capacitor 94 to a high-speed ramp voltage generator 93, and through a resistor 92 to the positive electrode of the d.c. power supply 90 which outputs a voltage of 100 volts. The positive electrode of the d.c. power supply 91 and the negative electrode of the d.c. power supply 90 are connected together. The fluorescent screen 85 is connected to the positive electrode of the d.c. power supply 89 which outputs a voltage of 6 kilovolts. The positive electrode of the d.c. power supply 90 and the negative electrode of the d.c. power supply 89 are connected together. The d.c. power supply 89 may have an even greater output capacity, and the negative electrode thereof may be connected to the negative electrode of the d.c. power supply 90, as well. The output of the high-speed ramp voltage generator 93 is decided, as will be described later, by the diameter and length of the through holes 95, but, at any rate, is not higher than 100 volts. So the potential of the shutter plate 84 is higher than that of the photocathode 83 and lower than that of the fluorescent screen 85. Also, the shutter plate 84 usually has a potential gradient between the electrodes 87 and 88.

The following paragraphs describe the operation of the shutter tube described above.

Before the high-speed ramp voltage generator 93 produces a ramp voltage, the electrons emitted from the photocathode 83 are accelerated in the direction of the shutter plate 84 and pass through the through holes 95. Because the voltage between the electrodes 87 and 88, there exists an electric field within, the perpendicular to, each through hole 95, so that the electrons are deflected as indicated by a curve a in FIG. 7, and then adsorbed by the internal wall of the through hole 95 on striking thereagainst. When there is no electric field in the through hole 95, the electrons pass through the through hole 95 as indicated by a curve c, without being deflected. Said curve being a parabola, the deflection Y at the exit end of the through hole 95 is expressed as $Y=l^2V\alpha/4dVo$, where l is the length of the through hole, d the diameter of the through hole, Vo the energy of the incoming electrons, and $V\alpha$ the voltage in the area opposite to the wall of the through hole. Here, the length is expressed in units of mm, the diameter in microns, the energy in electron volts, and the voltage in volts. When the length of the through hole is 5 mm, the diameter thereof is 25 microns, and the energy of the incoming electrons is 1 kilo electron volt, the electrons go past by the outlet edge of the through hole if Y=d. From the above equation, the voltage applied on the wall of the through hole is 0.1 volt. If the space between the electrodes 87 and 88 is 10 mm, the voltage applied therebetween is approximately 40 volts, as obtained by multiplying 0.1 volt by the ratio between the space between the electrodes 87 and 88 and the diameter of the through hole (i.e. 1 mm/25 microns=400). When the voltage applied between the electrodes 87 and 88 is greater than 40 volts, all electrons impinge on, and are absorbed by, the internal wall of the through hole 95. When the same voltage is smaller than 40 volts, the electrons pass through the through hole 95. Part of the electrons may strike against the wall of the through hole 95, which, however, does not impair the shutter function according to this invention. When the high-speed ramp voltage generator 93 generates a negative ramp voltage, the voltage at the electrode 87 drops from 100 volts through 40 volts, 0 volt and minus 40 volts down to minus 100 volts. When the voltage remains between 40 volts and minus 40 volts, the electrons pass through the through holes 95 to hit the fluorescent screen 85, thereby reproducing an image of the luminous event projected on the photocathode 83.

If the output voltage of the ramp voltage generator 93 changes at rate of 5 volts per picosecond, an exposure time of 16 picoseconds is obtained. This exposure time is 1/25 of the exposure time with the conventional shutter tube described previously.

The shutter tube of this invention can also produce the following result. The electrons emitted from the photocathode do not necessarily advance at right angles thereto. Although not exactly known, the probability that the electrons run in a direction forming an angle $\theta$ with the plane perpendicular to the photocathode is assumed to be proportional to cos $\theta$. The energy of the electrons emitted from the photocathode is not constant, but approximately 2 electron volts maximum. Accordingly, the maximum kinetic energy of the electrons emitted from the photocathode in a direction parallel to the surface of the photocathode is estimated as not more than 2 electron volts.

If the space between the photocathode 83 and shutter plate 84 is D, the voltage between the photocathode 83 and shutter plate 84 is Vo, and the kinetic energy of the electrons emitted from the photocathode in a direction parallel to the surface of the photocathode is Vi, the distance r from which the electrons hit a point on the shutter plate 84 that is opposite to the emitting point is expressed as $r=D\sqrt{Vi}/\sqrt{Vo}$. Here, the space is expressed in units of mm, the energy of electrons in electron volts, and voltage in volts. If D is 1 mm, Vi is 2 electron volts, and Vo is 1 kilovolt, r is 30 microns. Accordingly, the electrons emitted from one point on the photocathode passes through substantially one through hole. The kinetic energy of the electrons leaving the through hole 95 in a direction parallel to the surface of the shutter plate is imparted in the through hole 95 in the shutter plate 84, and is not more than approximately 0.1 electron volt. Meanwhile, the kinetic energy in a direction perpendicular to the shutter plate 84 is 1 kilo electron volt, and is further accelerated between the shutter plate 84 and fluorescent screen 85. Thus, the kinetic energy in a direction perpendicular to the shutter plate is by far greater than that in a direction parallel to the shutter plate. Therefore, if the space between the shutter plate 84 and fluorescent screen 85 is 1 mm, the electrons leaving a through hole 25 microns in diameter diffuse on the fluorescent screen to a diameter of only 40 microns. Thus, incorporating a shutter plate according to this invention in the shutter tube assures a high image resolution, even without the focusing electrode.

This invention is applicable not only to the shutter tube of the image tube type, but also to the shutter tube of the image orthicon tube type. That is, an image tube of the image orthicon tube type may be made up of a photocathode, a storage target, a suitable resistor provided between the photocathode and storage target, and a shutter plate that has a plurality of fine through holes running perpendicular to the surfaces thereof and two electrodes at opposite ends thereof. The structure of such a shutter tube of the image orthicon tube type differs from that of the shutter tube of the image tube type described before only in that the fluorescent screen is replaced with the storage target. The relative voltages applied on the photocathode, fluorescent screen and two electrodes on the shutter plate may be considered the same as with the shutter tube of the image tube type.

What is claimed is:

1. An electron-beam shutter for use in an optoelectronic device forming an image of a luminous event changing at high speed on a screen, which comprises:

a shutter plate disposed so that the surface thereof lies perpendicular to electron beams, the shutter plate having a multitude of through holes extending perpendicular to the surface thereof and a pair of electrodes disposed at opposite edges thereof and spaced away from each other in a direction perpendicular to the axis of the through holes; and a ramp voltage source connected to said electrodes and having a polarity that changes in a reversing manner, the ramp voltage generated thereby develops an electric field that crosses the axis of the through holes in the shutter plate to control the passage of the electron beams from a photocathode through the through holes.

2. A shutter tube which comprises:

a closed-end cylindrical airtight vacuum container having a light incidence window provided is one end thereof and a light emitting window in the other;

a photocathode provided on the inside of the light incidence window;

a fluorescent screen provided on the inside of the light emitting window;

a voltage source applying a constant voltage between the photocathode and fluorescent screen so that the potential of the latter becomes higher than that of the former;

a shutter plate disposed between and parallel to the photocathode and fluorescent screen, the shutter plate having a multitude of through holes extending perpendicular to the surface thereof and a pair of electrodes disposed at opposite edges thereof and spaced away from each other in a direction perpendicular to the axis of the through holes; and a ramp voltage source connected to said electrodes and having a polarity that changes in a reversing manner, the ramp voltage generated thereby develops an electric field that crosses the axis of the through holes in the shutter plate to control the passage of the electron beams from said photocathode through the through holes.

* * * * *